US005711028A

United States Patent [19]

Bourque et al.

[11] Patent Number: 5,711,028

[45] **Date of Patent: *Jan. 27, 1998**

[54] SHIN PAD CONSTRUCTION

[75] Inventors: René Bourque; Rodrigue McDuff, both of Laval; Daniel Chartrand, Deux-Montagnes, all of Canada

[73] Assignee: Canstar Sports, Inc., Canada

[ * ] Notice: The term of this patent shall not extend beyond the expiration date of Pat. No. 5,446,926.

[21] Appl. No.: 523,909

[22] Filed: Sep. 6, 1995

Related U.S. Application Data

[63] Continuation of Ser. No. 159,323, Nov. 30, 1993, abandoned.

[51] Int. Cl.[6] ..... A41D 13/00

[52] U.S. Cl. ..... 2/22; 29/525.1; 29/464

[58] Field of Search ..... 411/508, 509, 411/510, 913, 907, 908; 602/12, 16, 20, 23, 26; 2/22, 24, 16; 24/459, 453, 618, 107; 29/525.1, 453, 464

[56] References Cited

U.S. PATENT DOCUMENTS

| | | | |
|---|---|---|---|
| 3,772,704 | 11/1973 | Carbonneau | 2/22 |
| 4,627,108 | 12/1986 | Järvinen . | |
| 4,818,824 | 4/1989 | Dixit et al. | 24/453 X |
| 4,999,847 | 3/1991 | Barcelo | 2/22 X |
| 5,107,823 | 4/1992 | Fratesi . | |
| 5,446,926 | 9/1995 | Bourque et al. | 2/22 |

*Primary Examiner*—Paul C. Lewis
*Attorney, Agent, or Firm*—Finnegan, Henderson, Farabow, Garrett & Dunner, L.L.P.

[57] ABSTRACT

A shin pad for ice hockey or other sports is described, together with a method of manufacturing shin pads. The shin pad includes an elongated flexible lining, and a rigid or semi-rigid knee shield secured to the lining. A lower aspect of the knee shield has one or more lateral slots defined therein. In the preferred embodiment, there is one such slot, generally centrally located. A rigid or semi-rigid shin shield is provided with a corresponding tab or tabs projecting from the upper end thereof for insertion in the slot(s), thereby locating the upper end of the shin shield against the lining. The lower portion of the shin shield is secured against the lining by any suitable conventional means such as sewing or one or more rivets. In the method of manufacturing the shin pad, the knee shield is secured to the lining in conventional fashion, such as by sewing. The tab(s) on the shin shield is then simply inserted in the slot(s) on the knee shield, the shin shield is then positioned against the lining, and the lower portion of the shin shield is then secured against the lining, for example by a single fastener. Preferably, the fastener has a broad flexible base portion, a bell-shaped portion leading from the base portion to a shoulder portion, and a post projecting from the shoulder portion and having an annular flange extending therefrom. The shin shield and the lining are trapped between the shoulder portion and the annular flange.

13 Claims, 4 Drawing Sheets

SHIN PAD CONSTRUCTION

This application is a continuation of application Ser. No. 08/159,323, filed Nov. 30, 1993, now abandoned.

BACKGROUND OF THE INVENTION

1. Field of the Invention

This invention relates to shin pads for use as protective gear in contact sports, especially ice hockey.

2. Description of the Prior Art

In ice hockey, shins protectors or pads conventionally have a flexible elongated lining of felt, foam or sewn cushioning material which may be arranged to wrap partially around the front of a player's lower leg, from the ankle to just above the knee. Rigid or semi-rigid plastic shin and knee shields, of polyethylene for example, are secured to the outside of the pad. The shin shield runs from the ankle to just below the knee, and the knee shield covers the knee. Separate shield members are used so that the pad can flex to accommodate bending of the knee.

The shield members are conventionally sewn or riveted to the lining. For example, it is common to sew the knee shield to the lining, and to rivet the shin shield to the lining with large rivets in several spaced-apart locations. These operations are labor intensive, and add to the cost of producing the shin pad.

SUMMARY OF THE INVENTION

It is an object of the invention to provide a shin pad construction and a corresponding method of manufacturing shin pads, which results in a shin pad which is as effective as those in he prior art but which is considerably less expensive to manufacture.

Accordingly, in the invention, the shin pad includes an elongated flexible lining as in the prior art, and a knee shield secured to the lining, a lower aspect of the knee shield having one or more lateral slots defined therein. A shin shield, otherwise virtually identical to those in the prior art, is provided with a corresponding tab or tabs projecting from the upper end thereof, for insertion in the slot(s), thereby locating the upper end of the shin shield against the lining. The lower portion of the shin shield is secured against the lining by any suitable conventional means such as sewing or one or more fasteners, or preferably by the novel fastener or clip described herein. The word "fastener" as used in this specification is intended to include not only conventional rivets, but also fastening means such as the clip described herein.

In the preferred embodiment of the shin pad, there is only one slot and one tab, and a single clip to secure the shin shield against the lining. Preferably, the fastener has a broad flexible base portion, a bell-shaped portion leading from the base portion to a shoulder portion, and a post projecting from the shoulder portion and having an annular flange extending therefrom. The shin shield is trapped between the shoulder portion and the annular flange, and the lining is trapped between the shin shield and the base portion.

In the method of manufacturing the shin pad, the knee shield is secured to the lining in conventional fashion, such as by sewing. The rest of the manufacturing process is greatly simplified, however. The tab(s) on the shin shield is/are then simply inserted in the slot(s) on the knee shield, the shin shield is then positioned against the lining, and the lower portion of the shin shield is then secured against the lining, for example by rivets, or preferably by the novel clip described herein. More than one fastener may of course be used if preferred, or some suitable securing means other than rivets could be used.

The clip in the preferred embodiment is a flexible rubber clip having a broad, flexible base on the inside of the lining, with a flanged pin portion which projects through a hole in the shin shield, the flanges of the pin portion serving to lock the shield against the lining, by sandwiching the shield and the lining between the broad base and the flanges of the pin portion.

It will be appreciated that although the invention is especially designed for use in the sport of ice hockey, the same general construction could be readily adapted for use in shin pads in other sports where similar protection is required. The invention as defined in the appended claims is therefore not limited to ice hockey equipment.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

Figure 1:
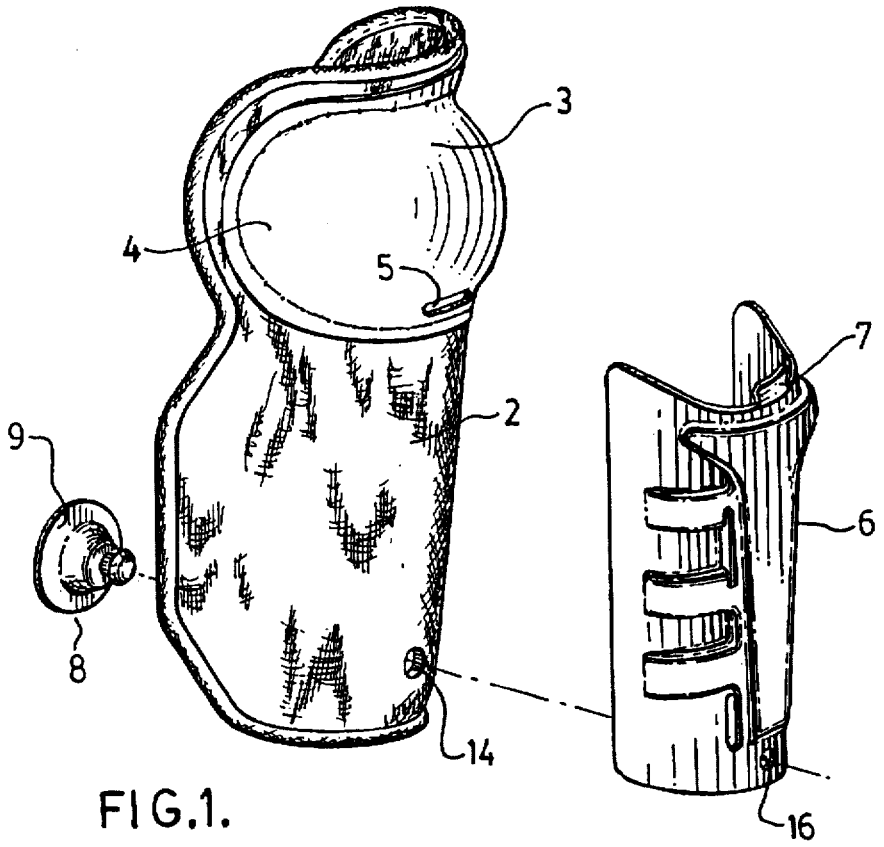
FIG. 1 is an exploded perspective of the preferred embodiment of the pad.
Figure 2:
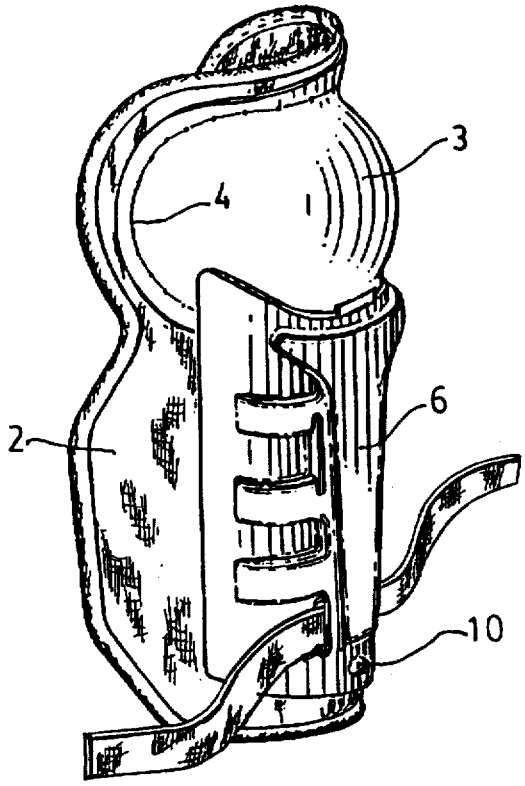
FIG. 2 is a perspective of the assembled pad.
Figure 3:
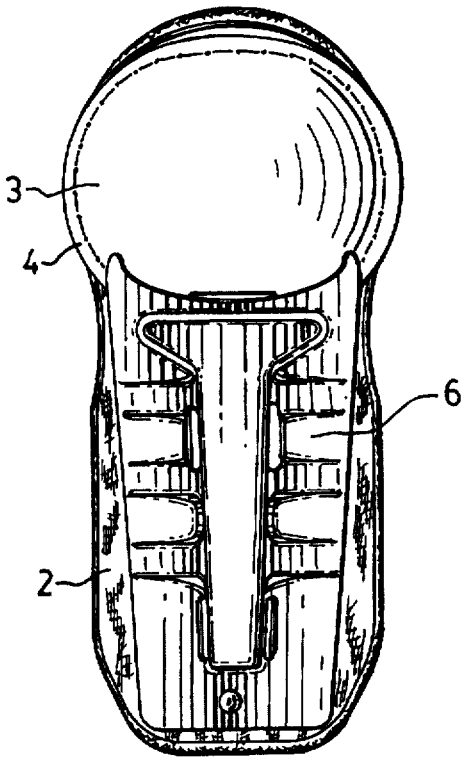
FIG. 3 is a front view of the assembled pad.
Figure 4:
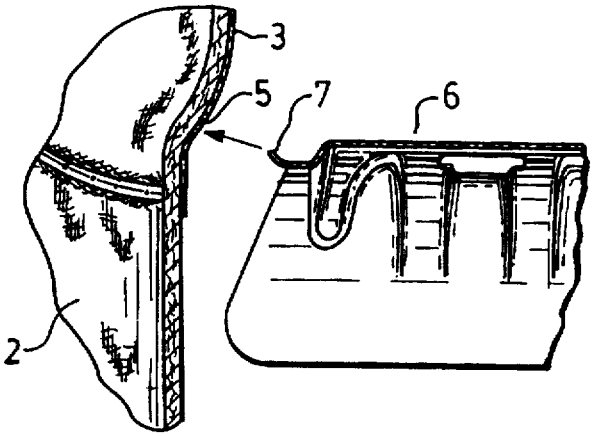
FIGS. 4–6 are cross-sections of the pad, showing the assembly sequence.
Figure 5:
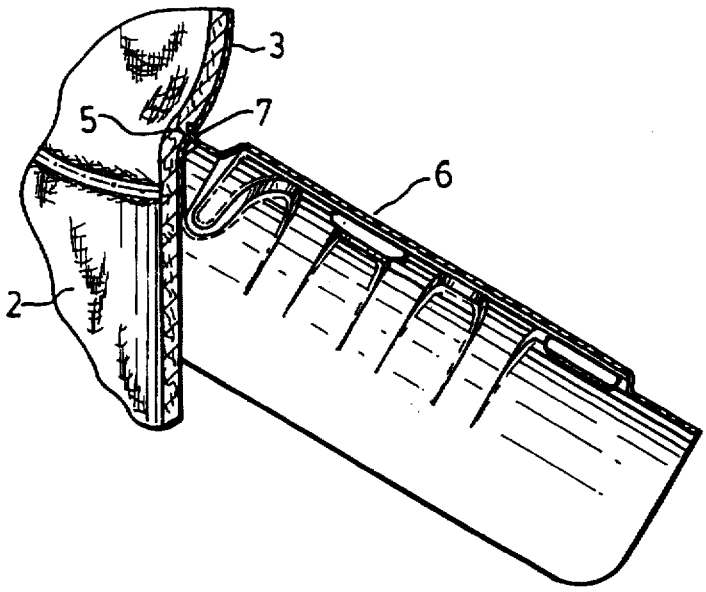
Figure 6:
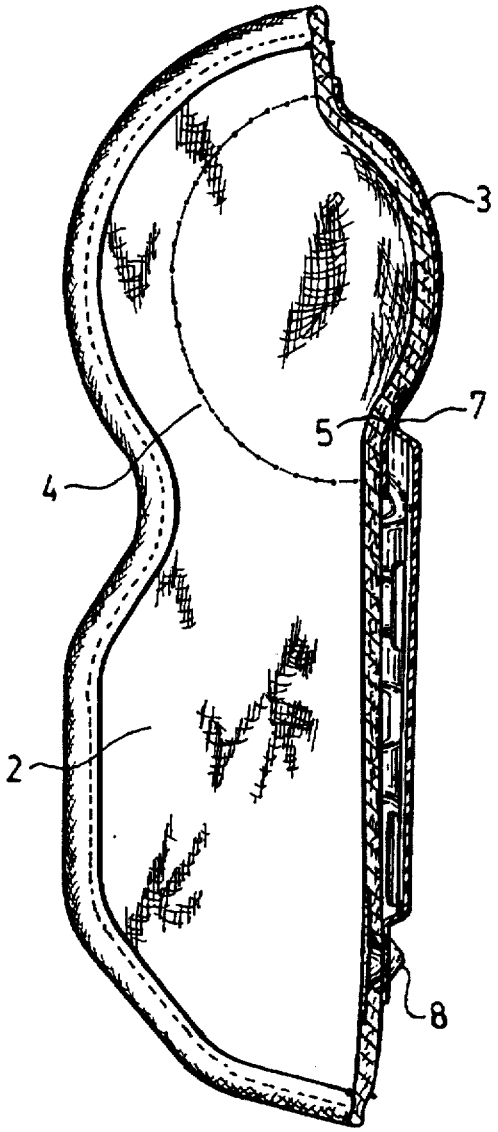
Figure 7:
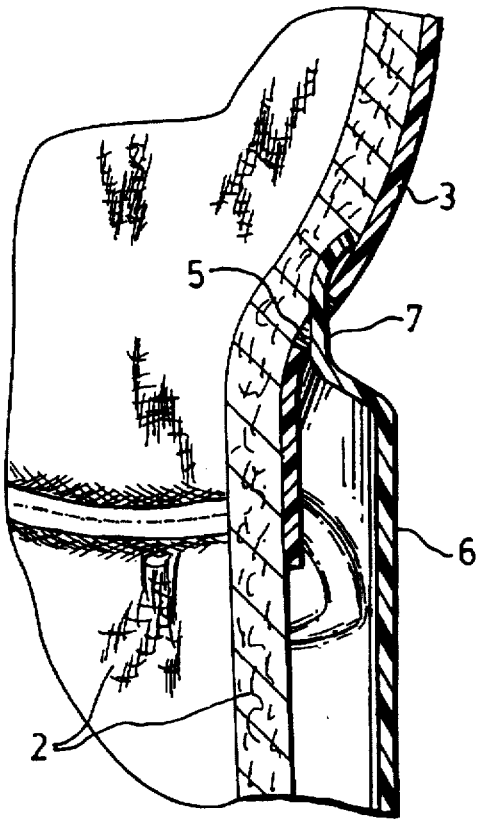
FIG. 7 is a cross-section of the pad, focusing on the area of the tab in the slot.
Figure 8:
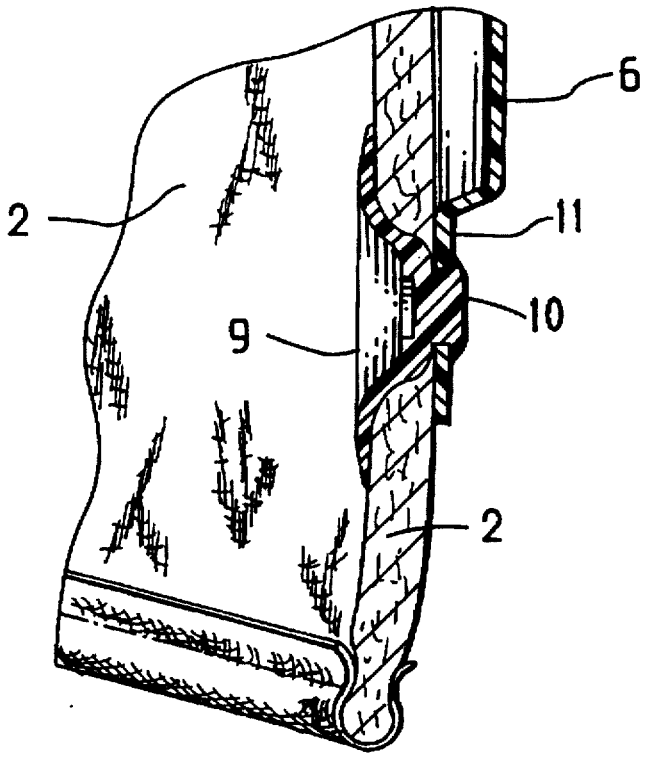
FIG. 8 is a cross-section of the pad, focusing on the area of the clip.

Referring to the drawings, the shin pad includes an elongated flexible lining 2 as in the prior art, and a rigid or semi-rigid knee shield 3 secured to the lining by any suitable mans, such as sewing 4. A lower aspect of the knee shield has a generally central lateral slot 5 therein. A rigid or semi-rigid shin shield 6, otherwise virtually identical to those in the prior art, is provided with a tab 7 projecting from the upper end thereof, for insertion in the slot, thereby locating the upper end of the shin shield against the lining. As mentioned above, more than one slot could be used if desired, with corresponding tabs.

The lower portion of the shin shield is secured against the lining by any suitable conventional means such as sewing or one or more rivets. In the preferred embodiment, a novel clip 8 is employed, only one being required.

Figure 9:
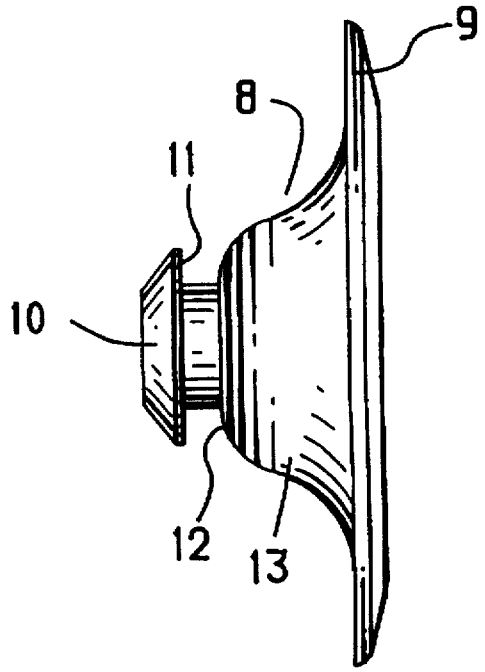
FIG. 9 is a side view of the clip.

The clip 8 preferably is as illustrate in FIG. 9, having a large, resilient base portion 9, since it is on the inside of the lining, i.e. almost contact with the player's leg, although preferably recessed somewhat by virtue of the compression of the lining which the clip produces.

The clip has a bell-shaped portion 13 leading from the base portion 9 to a shoulder 12. The post 10 projects outwardly therefrom, and has an annular flange 11 extending therefrom to catch the front of the shin shield, such that no special tools are essential; the clip can simply be inserted through a hole 14 in the lining, from the inside of the lining, and pressed through a hole 16 in the shin shield. The flange 11 then pops out to engage the front of the shin shield. The flange serves to lock the shield against the lining, by'sandwiching the shield and the lining between the flange 11 and the shoulder portion 12. This simple insertion of the clip can be done manually, or with a simple manual or automated tool, as desired.

In the method of manufacturing the shin pad, the knee shield 3 is secured to the lining 2 in conventional fashion, such as by sewing 4. The tab 7 is then simply inserted in the slot 5, the shin shield is positioned against the lining, and the clip 8 is installed. Fastening means other than the clip could be employed, but the full advantages of the invention in terms of reduced labor costs would then be only partially realized.

As mentioned previously, more than one clip may be used if preferred, for example one on either side of the lining towards the bottom thereof. Alternatively, some other suitable securing means could be used, such as sewing a lower portion of the shin shield to the lining. The use of the clips, and preferably just a single clip, is preferred, however, so as to minimize the amount of labor required, and thereby achieve the full advantage of the invention.

It will be appreciated that the above description relates to the preferred embodiment by way of example only. Many variations on the invention will be obvious to those knowledgeable in the field, and such obvious variations are within the scope of the invention as described and claimed, whether or not expressly described.

What is claimed as the invention is:

1. A shin pad, comprising:

an elongated flexible lining having an upper end and a lower end, adapted to lie against and wrap at least partially around a player's leg with the lower end at the player's ankle and the upper end above the player's knee;

a knee shield secured to a forward side of said lining near the upper end thereof, adapted to overlie the player's knee, a lower aspect of said knee shield having at least one lateral slot defined therein;

a shin shield adapted to overlie the player's lower leg from the ankle up to the knee shield, comprising at least one hook-shaped tab projecting from the upper end thereof, each said tab being appropriately sized to engage a corresponding slot, thereby locating the upper end of said shin shield against said lining; and means for securing a lower portion of said shin shield against said lining.

2. A shin pad as recited in claim 1, where said means for securing a lower portion of said shin shield against said lining comprises at least one fastener.

3. A shin pad as recited in claim 1, where said means for securing a lower portion of said shin shield against said lining comprises one fastener, centrally located on the front lower portion of said shin shield.

4. A shin pad as recited in claim 2, where each said fastener comprises a broad flexible base portion, a bell-shaped portion leading from the base portion to a shoulder portion, and a post projecting from said shoulder portion and having annular flange extending therefrom, where said shin shield and said lining are trapped between said shoulder portion and said annular flange.

5. A shin pad as recited in claim 3, where each said fastener comprises a broad flexible base portion, a bell-shaped portion leading from the base portion to a shoulder portion, and a post projecting from said shoulder portion and having an annular flange extending therefrom, where said shin shield and Said lining are trapped between said shoulder portion and said annular flange.

6. A shin pad as recited in claim 1, where there is only one said slot, generally centrally located on said lower aspect of said knee shield.

7. A shin pad as recited in claim 2, where there is only one said slot, generally centrally located on said lower aspect of said knee shield.

8. A shin pad as recited in claim 3, where there is only one said slot, generally centrally located on said lower aspect of said knee shield.

9. A shin pad as recited in claim 4, where there is only one said slot, generally centrally located on said lower aspect of Said knee shield.

10. A shin pad as recited in claim 5, where there is only one said slot, generally centrally located on said lower aspect of said knee shield.

11. A method of manufacturing a shin pad, comprising the steps of:

securing a knee shield, adapted to overlie a player's knee, to an elongated flexible lining having an upper end and a lower end, adapted to lie against and wrap at least partially around a player's leg with the lower end at the player's ankle and the upper end above the player's knee, said knee shield having at least one lateral slot defined in a lower aspect thereof;

then positioning a rigid or semi-rigid shin shield, said shin shield being adapted to overlie the player's lower leg from the ankle up to the knee shield and having at least one hook-shaped tab projecting from the upper end thereof, such that each said tab engages a corresponding slot, thereby locating the upper end of said shin shield against said lining; and then using fastening means to secure at least a lower portion of said shin shield against said lining.

12. A method as recited in claim 11, in which said step of securing at least said lower portion of said shin shield against said lining comprises using at least one fastener to so secure said shield against said lining.

13. A method as recited in claim 12, where each said fastener comprises a broad flexible base portion, a bell-shaped portion leading from the base portion to a shoulder portion, and a post projecting from said shoulder portion and having annular flange extending therefrom, where said shin shield and said lining are trapped between said shoulder portion and said annular flange.

* * * * *

UNITED STATES PATENT AND TRADEMARK OFFICE

CERTIFICATE OF CORRECTION

PATENT NO. : 5,711,028

DATED : Jan. 27, 1998

INVENTOR(S) : Rene Bourque, et al

It is certified that error appears in the above-identified patent and that said Letters Patent is hereby corrected as shown below:

Claim 4, column 4, line 3, before "annular", insert --an--.

Claim 5, column 4, line 11, "Said" should read --said--.

Claim 9, column 4, line 24, "Said" should read --said--.

Claim 13, column 4, line 55, before "annular", insert --an--.

Signed and Sealed this

Twenty-first Day of April, 1998

Bruce Lehman

*Attest:*

BRUCE LEHMAN

*Attesting Officer*

*Commissioner of Patents and Trademarks*